US011779987B2

(12) United States Patent
Saika et al.

(10) Patent No.: US 11,779,987 B2
(45) Date of Patent: Oct. 10, 2023

(54) FORMING DEVICE

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 237 days.

(21) Appl. No.: 17/121,269

(22) Filed: Dec. 14, 2020

(65) Prior Publication Data

US 2021/0101199 A1 Apr. 8, 2021

Related U.S. Application Data

(60) Division of application No. 15/717,730, filed on Sep. 27, 2017, now abandoned, which is a continuation of application No. PCT/JP2016/060482, filed on Mar. 30, 2016.

(58) Field of Classification Search
USPC ..... 72/61
See application file for complete search history.

(30) Foreign Application Priority Data

Mar. 31, 2015 (JP) ..... 2015-072089

(51) Int. Cl.
*B21D 26/047* (2011.01)
*B21D 26/033* (2011.01)
*B21D 19/00* (2006.01)

(52) U.S. Cl.
CPC ..... *B21D 26/047* (2013.01); *B21D 19/00* (2013.01); *B21D 26/033* (2013.01)

(58) Field of Classification Search
CPC .... B21D 26/02; B21D 26/033; B21D 26/045; B21D 26/047; Y10T 29/49805
(Continued)

(56) References Cited

U.S. PATENT DOCUMENTS 4,414,834 A * 11/1983 Gratzer ..... B21D 26/045 72/58
4,748,836 A 6/1988 Hoeboer et al.
(Continued)

FOREIGN PATENT DOCUMENTS

EP 0 237 128 A1 9/1987
EP 0 873 802 A1 10/1998
(Continued)

OTHER PUBLICATIONS

Komatsu, Translation of JP-2012000654-A (Year: 2012).*
Article 94(3) EPC Communication issued in European Application No. 19 175 019.9-1016, dated Apr. 5, 2022.
(Continued)

*Primary Examiner* — Bobby Yeonjin Kim
(74) *Attorney, Agent, or Firm* — Michael Best & Friedrich LLP

(57) ABSTRACT

A forming device includes a blow-forming die and a shielding member. The blow-forming die includes a first die that protrudes from a first die holder towards a second die holder and a second die that protrudes from the second die holder towards the first die holder. The shielding member is configured to extend from the first die holder to the second die holder before the blow-forming die commences forming a flange part of a pipe in a sub-cavity part. The sub-cavity part is between a main cavity part and the shielding member. The shielding member is separated from the first die and the second die.

20 Claims, 10 Drawing Sheets

(56) References Cited

U.S. PATENT DOCUMENTS

| | | | | |
|---|---|---|---|---|
| 5,321,964 | A * | 6/1994 | Shimanovski | B21D 26/045 72/62 |
| 5,890,387 | A * | 4/1999 | Roper | B21D 26/035 72/58 |
| 8,171,769 | B2 | 5/2012 | Barthelemy et al. | |
| 2014/0367002 | A1* | 12/2014 | Naitou | C22C 38/28 148/333 |

FOREIGN PATENT DOCUMENTS

| | | | | |
|---|---|---|---|---|
| EP | 0 873 802 | A1 | | 10/1998 |
| JP | S59-171299 | U | | 11/1984 |
| JP | S62-282728 | A | | 12/1987 |
| JP | 2002-292436 | A | | 10/2002 |
| JP | 2006-061944 | A | | 3/2006 |
| JP | 2006-122979 | A | | 5/2006 |
| JP | 2006-122979 | A | | 5/2006 |
| JP | 2012-000654 | A | | 1/2012 |
| JP | 2012-000654 | A | | 1/2012 |
| JP | 2012000654 | A | * | 1/2012 |

OTHER PUBLICATIONS

International Search report issued in Application No. PCT/JP2016/060482, dated Jun. 7, 2016.
Supplementary Search Report issued in European Application No. 16773015.9, dated Apr. 30, 2018.
Search Report issued in European Patent Application No. 19175019.9, dated Oct. 10, 2019.

* cited by examiner

FORMING DEVICE

RELATED APPLICATIONS

This is a divisional of U.S. patent application Ser. No. 15/717,730 filed on Sep. 27, 2017, now pending, the contents of which are incorporated herein by reference in their entirety. Priority is claimed to Japanese Patent Application No. 2015-072089, filed Mar. 31, 2015, and International Patent Application No. PCT/JP2016/060482, the entire content of each of which is incorporated herein by reference.

BACKGROUND

Technical Field

Certain embodiments of the present invention relate to a forming device.

Description of Related Art

For example, a forming device described in the related art has been known as a forming device that forms a metal pipe having a pipe part and a flange part. The forming device described in the related art includes: a pair of an upper die and a lower die and a gas supply part that supplies a high-pressure gas that is a gas into a metal pipe material held between the upper die and the lower die. By combining the upper die and the lower die together, a main cavity part for forming a pipe part and a sub-cavity part that communicates with the main cavity part to form a flange part are configured between the upper die and the lower die. In this forming device, a metal pipe material is expanded with the supply of a gas into the metal pipe material in a case where the upper die and the lower die are closed. Accordingly, the pipe part and the flange part can be simultaneously formed.

Specifically, parting surfaces (matching surfaces) of the upper die and the lower die are formed in steps toward the center from the outside. When the upper die and the lower die are closed, a main cavity part as a forming space is formed between the parting surfaces at the center of the upper die and the lower die, and a sub-cavity part is formed as a forming space communicating with the main cavity part on a side of the main cavity part between the parting surfaces of the upper die and the lower die. The sub-cavity part is closed by the stepped parting surfaces of the upper die and the lower die and becomes a closed space in the die.

SUMMARY

According to an aspect of the invention, a forming device includes a blow-forming die and a shielding member. The blow-forming die includes a first die that protrudes from a first die holder towards a second die holder and a second die that protrudes from the second die holder towards the first die holder. The shielding member is configured to extend from the first die holder to the second die holder before the blow-forming die commences forming a flange part of a pipe in a sub-cavity part. The sub-cavity part is between a main cavity part and the shielding member. The shielding member may be separated from the first die and the second die.

BRIEF DESCRIPTION OF THE DRAWINGS

FIG. 3A is a view showing a state in which a metal pipe material is held by the electrodes.

FIG. 3B is a view showing a state in which a sealing member is brought into contact with the electrodes. FIG. 3C is a front view of the electrodes.

FIG. 4A is a diagram showing a state in which a metal pipe material is set in a die. FIG. 4B is a diagram showing a state in which the metal pipe material is held by the electrodes.

DETAILED DESCRIPTION

Figure 1:
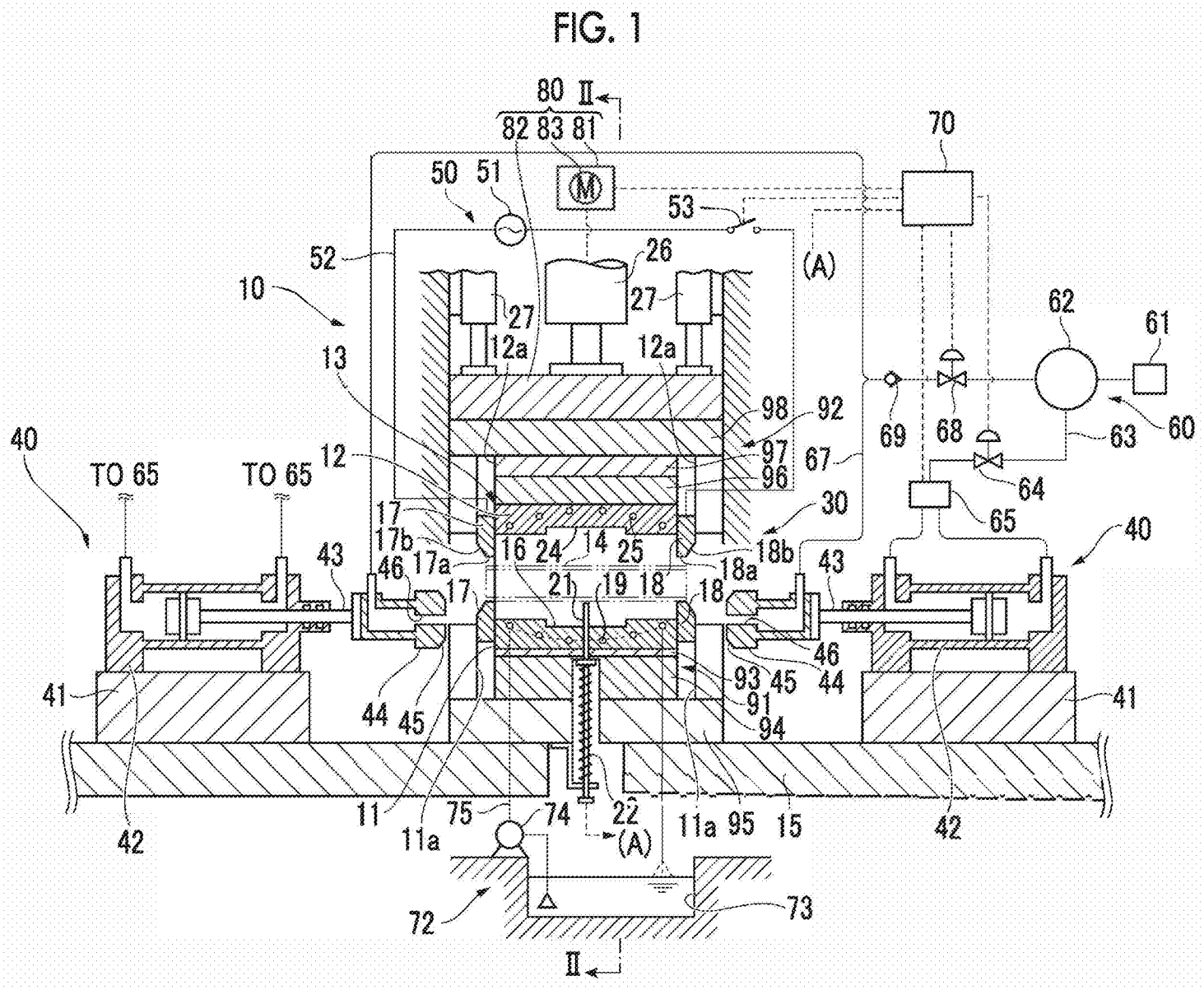
FIG. 1 is a schematic diagram showing a configuration of a forming device according to one embodiment of the invention.

Here, in the forming device, as described above, a sub-cavity part corresponding to a shape (thickness and length) of a flange part becomes a closed space in the die. Accordingly, in a case where the flange part is formed with the supply of a high-pressure gas, there is a concern that the flange part may deform, and a flange part having a desired shape may not be formed.

Accordingly, in order to prevent the deformation of the flange part, it is considered that the sub-cavity part that is a forming space is expanded to the outside of the die to make it open to the outside. However, in a case where the sub-cavity part is made open to the outside, there is a concern that foreign matter such as fragments may fly to the outside of the die and scatter to the surroundings in a case where it is assumed that a material itself has a low strength, and thus a metal pipe bursts due to a high-pressure gas in the die.

It is desirable to provide a forming device that can prevent foreign matter such as fragments generated in a die from scattering to the surroundings of the die.

According to the forming device, in the expanding and forming of the metal pipe material between the upper die and the lower die, foreign matter such as fragments may be generated in the main cavity part or the sub-cavity part. In this case, the foreign matter moves outward in the extending direction of the sub-cavity part, crossing the extending direction of the metal pipe material. The foreign matter is prevented from advancing by the shielding member provided on the extending line of the sub-cavity part in the expanding of the metal pipe material. Accordingly, the foreign matter discharged from the main cavity part or the sub-cavity part can be prevented from scattering to the surroundings of the die.

Here, the shielding member may block the sub-cavity part from a direction in which the sub-cavity part is extended. In a case where such a configuration is employed, the sub-cavity part is blocked from the extending direction of the sub-cavity part, and thus the foreign matter can be securely prevented from scattering to the surroundings of the die without being discharged to the outside of the die.

In addition, the shielding member may be provided to be brought into contact with a side surface of the upper die or the lower die and may be moved with the movement of the upper die or the lower die to block the sub-cavity part from the direction in which the sub-cavity part is extended in a case where the die is closed. In a case where such a configuration is employed, a die holder holding the die can be used as the shielding member and there is no need to provide a separate shielding member. In addition, in a case where the shielding member is provided to be brought into contact with a side surface of the upper die, in a state in which the shielding member is released from the die, the shielding member is separated upward from the lower die together with the upper die. Accordingly, for example, in a case where the metal pipe material is inserted into the lower die or in a case where the formed metal pipe is detached from the lower die, the shielding member does not become a hindrance.

Hereinafter, preferable embodiments of a forming device according to an aspect of the invention will be described with reference to the drawings. In the drawings, the same or similar parts will be denoted by the same reference signs, and overlapping description will be omitted.

Configuration of Forming Device

Figure 2:
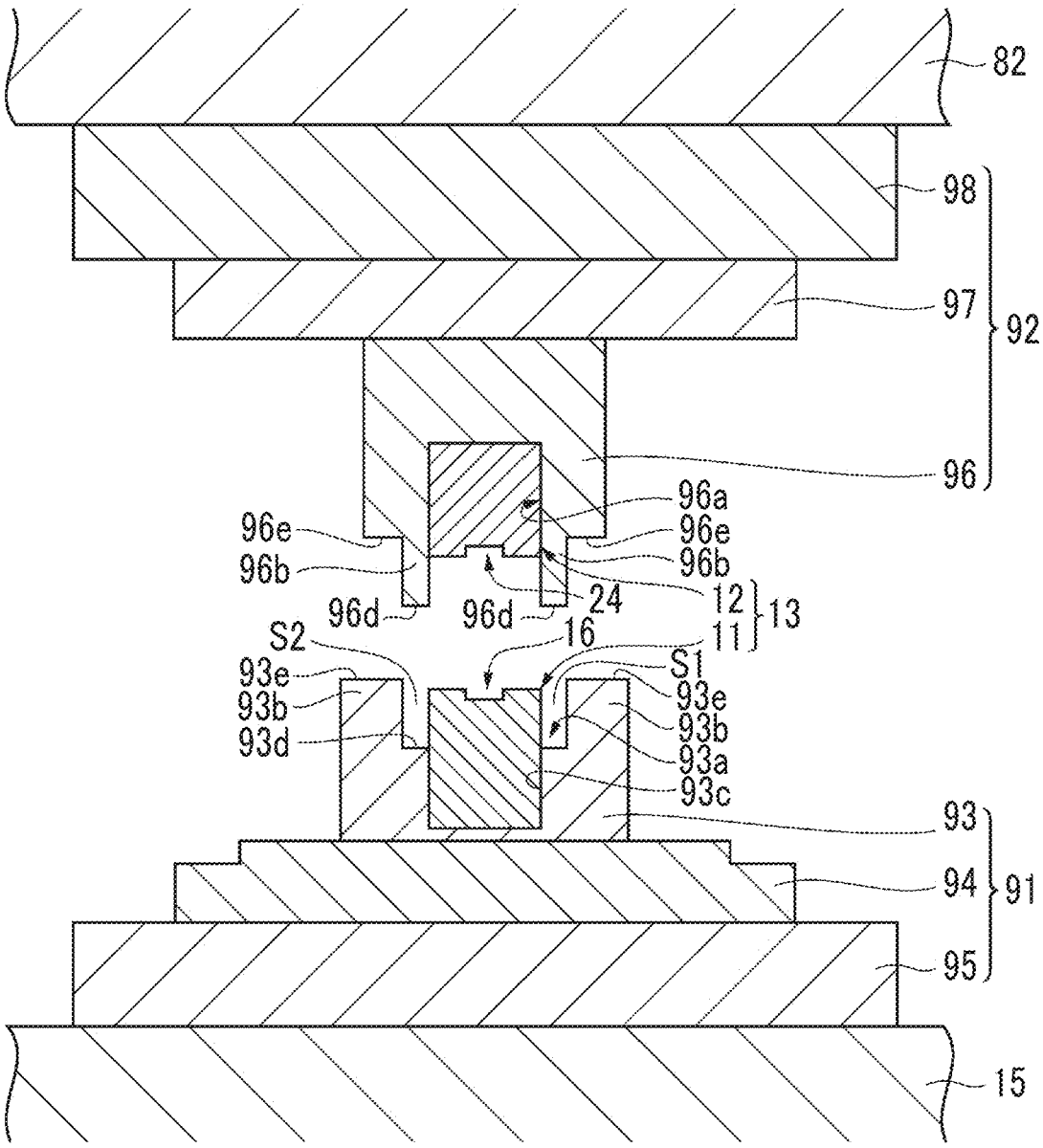
FIG. 2 is a transverse sectional view of a blow-forming die and upper die and lower die holding parts, taken along the line II-II of FIG. 1.

FIG. 1 is a schematic diagram of a configuration of a forming device. FIG. 2 is a transverse sectional view of a blow-forming die, an upper die holding part, and a lower die holding part, taken along the line II-II of FIG. 1. As shown in FIG. 1, a forming device 10 that forms a metal pipe 100 (see FIG. 5) is provided with a blow-forming die 13 composed of a pair of a lower die 11 and an upper die 12, a lower die holding part 91 for holding the lower die 11, an upper die holding part 92 for holding the upper die 12, a driving mechanism 80 that moves at least one of the lower die holding part 91 holding the lower die 11 and the upper die holding part 92 holding the upper die 12 (here, upper die holding part 92), a pipe holding mechanism 30 that holds a metal pipe material 14 shown by the virtual line between the lower die 11 and the upper die 12, a heating mechanism 50 that energizes the metal pipe material 14 held by the pipe holding mechanism 30 to heat the metal pipe material, a gas supply part 60 for supplying a high-pressure gas (gas) into the metal pipe material 14 held and heated between the lower die 11 and the upper die 12, a pair of gas supply mechanisms 40 for supplying a gas into the metal pipe material 14 held by the pipe holding mechanism 30 from the gas supply part 60, and a water circulation mechanism 72 that forcibly cools the blow-forming die 13 with water. In addition, the forming device 10 is provided with a controller 70 that controls driving of the driving mechanism 80, driving of the pipe holding mechanism 30, driving of the heating mechanism 50, and gas supply of the gas supply part 60.

The lower die 11 is fixed to a large base 15 via the lower die holding part 91. The lower die 11 is composed of a large steel block and is provided with a recessed part 16 in an upper surface thereof (a parting surface from the upper die 12). As shown in FIGS. 1 and 2, the lower die holding part 91 holding the lower die 11 is provided with a lower die holder 93 holding the lower die 11, a lower die member 94 holding the lower die holder 93, and a lower die base plate 95 holding the lower die member 94, that are laminated in order from the top. The lower die base plate 95 is fixed to the base 15. As shown in FIG. 1, lengths of the lower die holder 93 and the lower die member 94 in an axial direction (lengths in the horizontal direction in FIG. 1) are almost the same as that of the lower die 11 in the axial direction.

An electrode storage space 11*a* is provided near each of right and left ends (right and left ends in FIG. 1) of the lower die 11, and a first electrode 17 and a second electrode 18 that are configured to advance or retreat in a vertical direction by an actuator (not shown) are provided in the electrode storage spaces 11*a*. Recessed grooves 17*a* and 18*a* having a semi-arc shape corresponding to an outer peripheral surface on the lower side of the metal pipe material 14 are formed in upper surfaces of the first electrode 17 and the second electrode 18, respectively (see FIG. 3C). The metal pipe material 14 can be placed to be well-fitted in the recessed grooves 17*a* and 18*a*. In addition, in front surfaces of the first and second electrodes 17 and 18 (surfaces of the die in an outward direction), tapered recessed surfaces 17*b* and 18*b* are formed such that the vicinities thereof are recessed at an angle into a tapered shape toward the recessed grooves 17*a* and 18*a*, respectively. In addition, the lower die 11 has a cooling water passage 19 formed therein and is provided with a thermocouple 21 inserted from the bottom at a substantially center thereof. This thermocouple 21 is supported movably up and down by a spring 22.

The pair of first and second electrodes 17 and 18 positioned in the lower die 11 constitute the pipe holding mechanism 30, and can elevatably support the metal pipe material 14 between the upper die 12 and the lower die 11. The thermocouple 21 is just an example of the temperature measuring unit, and a non-contact temperature sensor such as a radiation thermometer or an optical thermometer may be provided. A configuration without the temperature measuring unit may also be employed if the correlation between the energization time and the temperature can be obtained.

The upper die 12 is a large steel block that is provided with a recessed part 24 in a lower surface thereof (a parting surface from the lower die 11) and a cooling water passage 25 built therein. As shown in FIGS. 1 and 2, the upper die holding part 92 holding the upper die 12 is provided with an upper die holder 96 holding the upper die 12, an upper die member 97 holding the upper die holder 96, and an upper die base plate 98 holding the upper die member 97, that are laminated in order from the bottom. The upper die base plate 98 is fixed to a slide 82. As shown in FIG. 1, lengths of the upper die holder 96 and the upper die member 97 in an axial direction (lengths in the horizontal direction in FIG. 1) are almost the same as that of the upper die 12 in the axial direction. The slide 82 to which the upper die holding part 92 is fixed is suspended by a pressing cylinder 26, and is guided by a guide cylinder 27 so as not to laterally vibrate.

Similarly to the case of the lower die 11, an electrode storage space 12*a* is provided near each of right and left ends (right and left ends in FIG. 1) of the upper die 12, and a first electrode 17 and a second electrode 18 that are configured to advance or retreat in the vertical direction by an actuator (not shown) are provided in the electrode storage spaces 12*a*. Recessed grooves 17*a* and 18*a* having a semi-arc shape corresponding to an outer peripheral surface on the upper side of the metal pipe material 14 are formed in lower surfaces of the first and second electrodes 17 and 18, respectively (see FIG. 3C), and the metal pipe material 14 can be well fitted in the recessed grooves 17*a* and 18*a*. In addition, in front surfaces of the first and second electrodes 17 and 18 (surfaces of the die in an outward direction), tapered recessed surfaces 17*b* and 18*b* are formed such that the vicinities thereof are recessed at an angle into a tapered shape toward the recessed grooves 17*a* and 18*a*, respectively. Accordingly, in a case where the pair of first and second electrodes 17 and 18 positioned in the upper die 12 also constitute the pipe holding mechanism 30 and the metal pipe material 14 is sandwiched between the upper and lower pairs of first and second electrodes 17 and 18 from the vertical direction, the metal pipe material 14 can be surrounded such that the outer periphery thereof firmly adheres well over the whole periphery. The fixing parts of the respective actuators moving the first electrode 17 and the second electrode 18 corresponding to a moving part up and down are held and fixed to the lower die holding part 91 and the upper die holding part 92, respectively.

The driving mechanism 80 is provided with a slide 82 that moves the upper die 12 and the upper die holding part 92 so as to combine the upper die 12 and the lower die 11 together, a driving part 81 that generates a driving force for moving the slide 82, and a servo motor 83 that controls a fluid amount with respect to the driving part 81. The driving part 81 is composed of a fluid supply part that supplies a fluid (an operating oil in a case where a hydraulic cylinder is employed as the pressing cylinder 26) for driving the pressing cylinder 26 to the pressing cylinder 26.

The controller 70 can control the movement of the slide 82 by controlling the amount of the fluid to be supplied to the pressing cylinder 26 by controlling the servo motor 83 of the driving part 81. The driving part 81 is not limited to a part that applies a driving force to the slide 82 via the pressing cylinder 26 as described above. For example, the driving part may be mechanically connected to the slide 82 to directly or indirectly apply a driving force generated by the servo motor 83 to the slide 82. For example, a driving mechanism having an eccentric shaft, a driving source (for example, a servo motor and a reducer) that applies a rotating force for rotating the eccentric shaft, and a converter (for example, a connecting rod or an eccentric sleeve) that converts the rotational movement of the eccentric shaft into the linear movement to move the slide may be employed. In this embodiment, the driving part 81 may not have the servo motor 83.

As shown in FIG. 2, an upper end surface of the lower die 11 and a lower end surface of the upper die 12 are uneven. Specifically, the recessed part 16 with a rectangular cross-sectional shape is formed at the center of the upper end surface of the lower die 11, and the recessed part 24 with a rectangular cross-sectional shape is formed at the center of the lower end surface of the upper die 12 to be opposed to the recessed part 16 of the lower die 11.

The lower die holder 93 that constitutes the lower die holding part 91 and holds the lower die 11 is provided with a recessed part 93*a* with a rectangular cross-sectional shape at a center of an upper end surface 93*e* of the rectangular parallelepiped. The lower die 11 is held such that the substantially lower half thereof is fitted into a recessed part 93*c* with a rectangular cross-sectional shape provided at the center of a bottom surface 93*d* of the recessed part 93*a*. Spaces S1 and S2 are respectively provided between protrusions 93*b* at both sides that form the recessed part 93*a* of the lower die holder 93 and side surfaces of the substantially upper half of the lower die 11 that protrude higher than the bottom surface 93*d* of the lower die holder 93. Protrusions 96*b* of the upper die holder 96 to be described later proceed into the spaces S1 and S2 in a case where the blow-forming die 13 is closed.

The upper die holder 96 that constitutes the upper die holding part 92 and holds the upper die 12 is formed into a stepped block shape, in which the rectangular parallelepiped becomes smaller downward in a stepwise manner, by forming two steps toward the lower side from the upper side at both sides of the rectangular parallelepiped. A recessed part 96*a* with a rectangular cross-sectional shape is formed at a center of a lower end surface 96*d* of the upper die holder 96, and the upper die 12 is held to be housed in the recessed part 96*a*. Accordingly, inner surfaces of the protrusions 96*b* at both sides that form the recessed part 96*a* of the upper die holder 96 are brought into contact with the side surfaces of the upper die 12. In addition, the protrusions 96*b* protrude downward from the lower end surface of the upper die 12 by a predetermined length, and respectively proceed into the spaces S1 and S2 of the lower die holder 93 in a case where the blow-forming die 13 is closed. In addition, in a case where the blow-forming die 13 is closed, the lower end surface (tip end surface) 96*d* of the protrusion 96*b* of the upper die holder 96 is brought into contact with the bottom surface 93*d* of the recessed part 93*a* of the lower die holder 93, and step surfaces 96*e* that form the protrusions 96*b* at both sides of the protrusions 96*b* of the upper die holder 96 and are positioned above the protrusions 96*b* are brought into contact with the upper end surfaces 93*e* of the protrusions 93*b* of the lower die holder 93.

As shown in FIG. 1, the heating mechanism 50 has a power supply 51, conductive wires 52 that extend from the power supply 51 and are connected to the first electrodes 17 and the second electrodes 18, and a switch 53 that is provided in the conductive wire 52. The controller 70 controls the heating mechanism 50, and thus the metal pipe material 14 can be heated to a quenching temperature (equal to or higher than an AC3 transformation temperature).

Figure 3A:
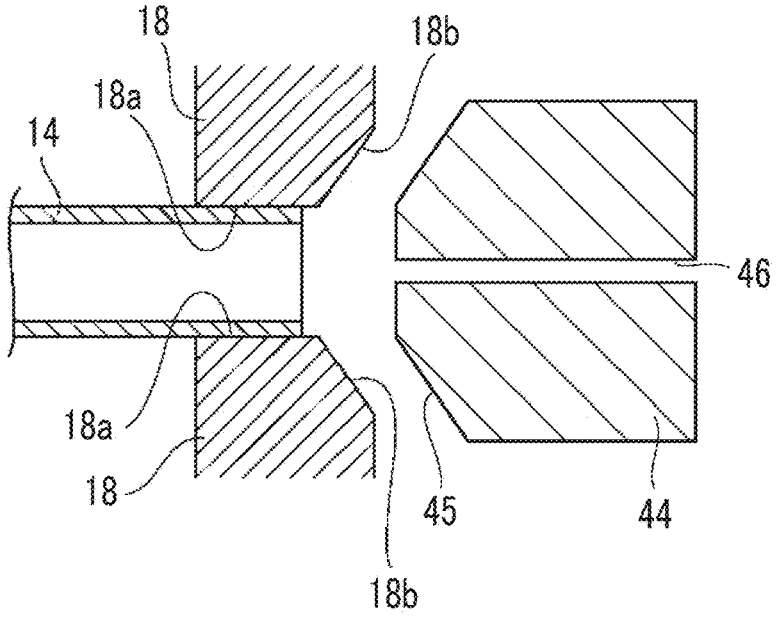
FIGS. 3A to 3C are enlarged views of the vicinity of electrodes.
Figure 3B:
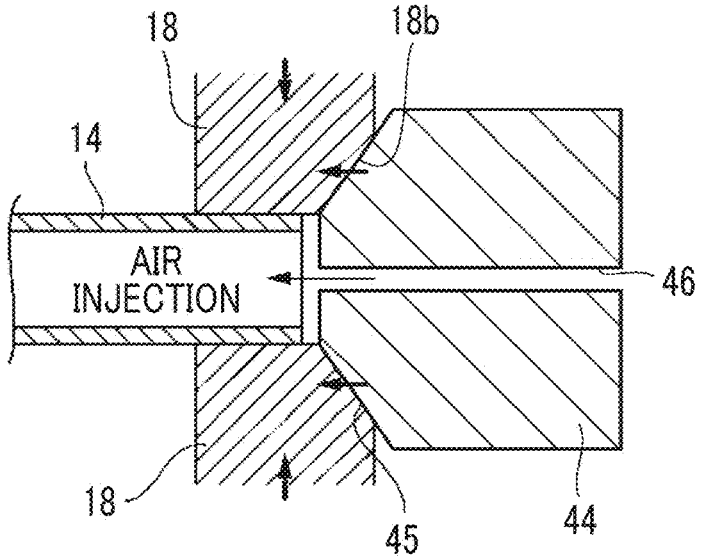
Figure 3C:
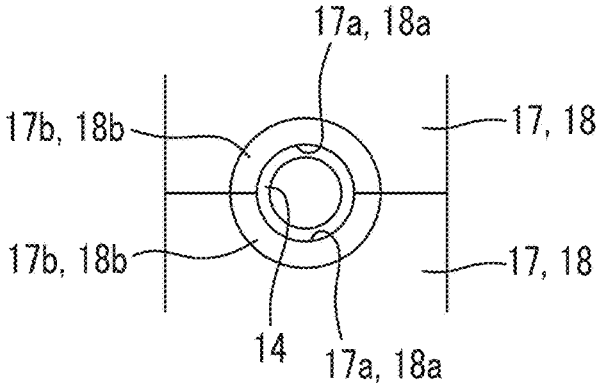

Each of the pair of gas supply mechanisms 40 has a cylinder unit 42, a cylinder rod 43 that advances or retreats in accordance with the operation of the cylinder unit 42, and a sealing member 44 that is connected to a tip end of the cylinder rod 43 on the side of the pipe holding mechanism 30. The cylinder unit 42 is placed and fixed on the base 15 via a block 41. A tapered surface 45 is formed at a tip end of the sealing member 44 so as to be tapered. The tapered surfaces are formed into such a shape as to be well fitted in and brought into contact with the tapered recessed surfaces 17*b* and 18*b* of the first and second electrodes 17 and 18 (see FIGS. 3A to 3C). The sealing member 44 is provided with a gas passage 46 that extends from the cylinder unit 42 toward the tip end, specifically, through which a high-pressure gas supplied from the gas supply part 60 flows as shown in FIGS. 3A and 3B.

As shown in FIG. 1, the gas supply part 60 includes a high-pressure gas supply 61, an accumulator 62 that stores a gas supplied by the high-pressure gas supply 61, a first tube 63 that extends from the accumulator 62 to the cylinder unit 42 of the gas supply mechanism 40, a pressure control valve 64 and a switching valve 65 that are provided in the first tube 63, a second tube 67 that extends from the accumulator 62 to the gas passage 46 formed in the sealing member 44, and a pressure control valve 68 and a check valve 69 that are provided in the second tube 67. The pressure control valve 64 functions to supply, to the cylinder unit 42, a gas having an operation pressure adapted for the pressing force of the sealing member 44 with respect to the metal pipe material 14. The check valve 69 functions to prevent the high-pressure gas from flowing backward in the second tube 67.

The controller 70 controls the pressure control valve 68 of the gas supply part 60, and thus a gas having a desired operation pressure can be supplied into the metal pipe material 14. In addition, the controller 70 acquires temperature information from the thermocouple 21 by the transmission of the information from (A) shown in FIG. 1, and controls the pressing cylinder 26 and the switch 53.

The water circulation mechanism 72 includes a water tank 73 that stores water, a water pump 74 that draws up and pressurizes the water stored in the water tank 73 to send the water to the cooling water passage 19 of the lower die 11 and the cooling water passage 25 of the upper die 12, and a pipe 75. Although omitted, a cooling tower that lowers the water temperature or a filter that purifies the water may be provided in the pipe 75.

Method of Forming Metal Pipe Using Forming Device

Figure 4A:
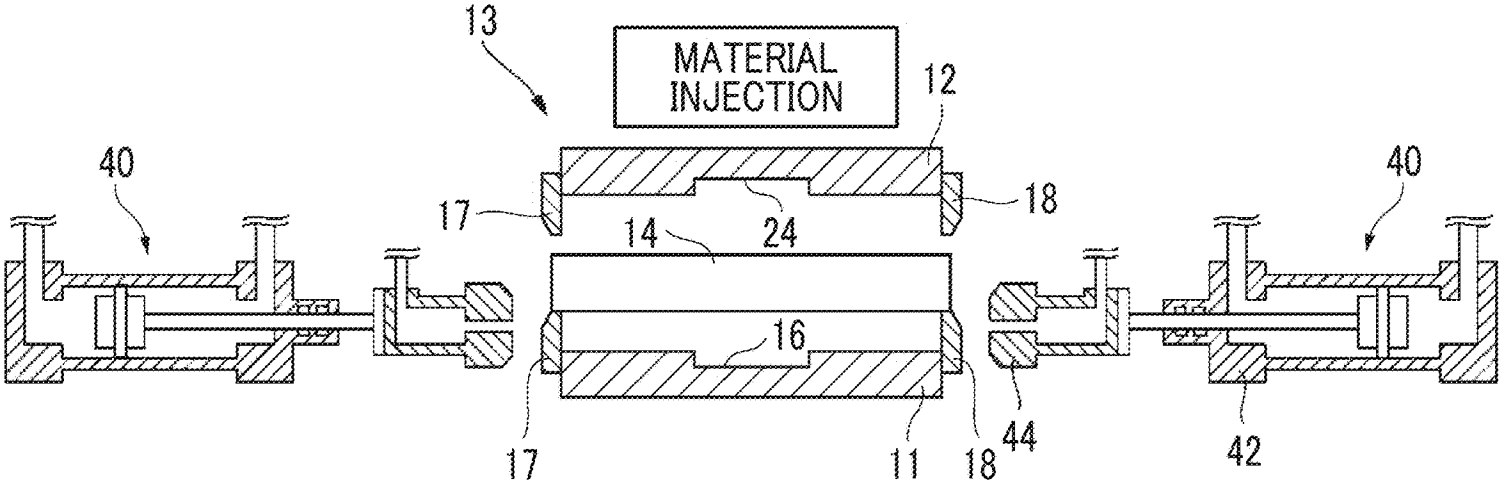
FIGS. 4A and 4B are diagrams showing a manufacturing step using the forming device.
Figure 4B:
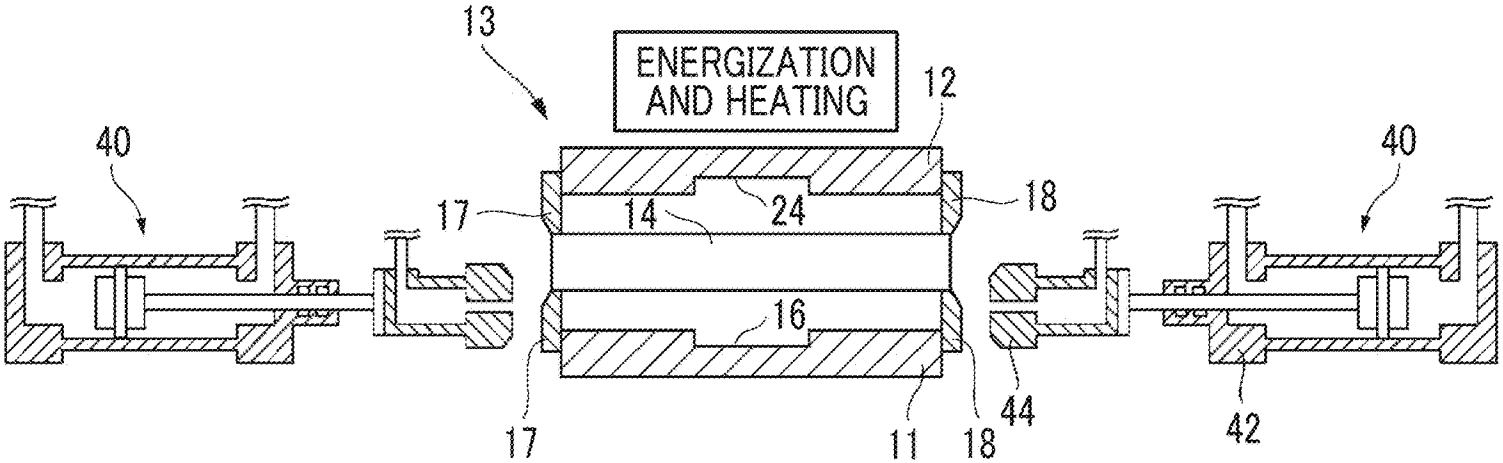
Figure 5:
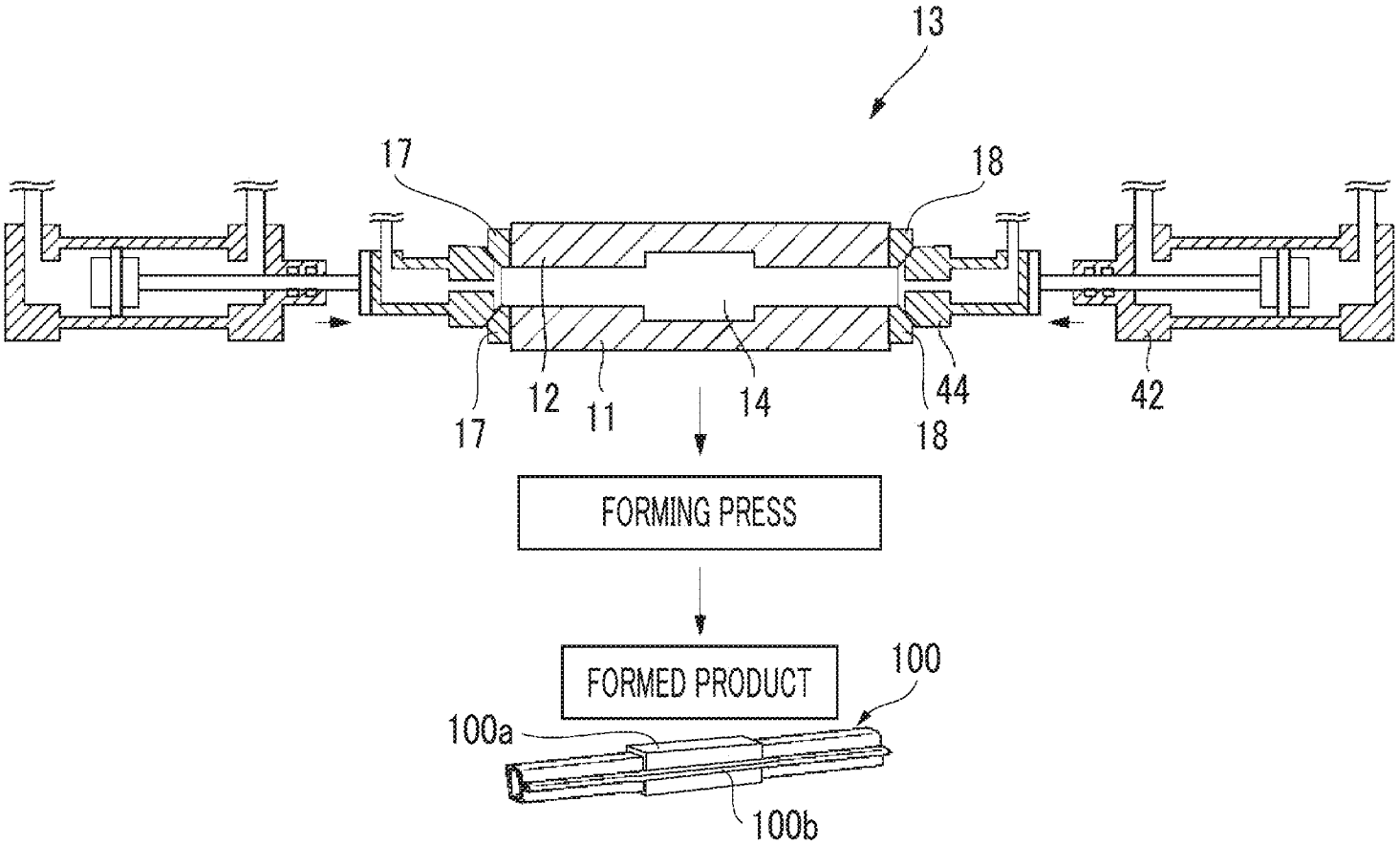
FIG. 5 is a diagram showing a manufacturing step following the steps in FIGS. 4A and 4B.

Next, a method of forming a metal pipe using the forming device 10 will be described. FIGS. 4A and 4B show steps from a pipe injection step for injecting the metal pipe material 14 as a material to an energization and heating step for heating the metal pipe material 14 by energization. More specifically, FIG. 4A is a diagram showing a state in which the metal pipe material is set in the die. FIG. 4B is a diagram showing a state in which the metal pipe material is held by the electrodes. FIG. 5 is a diagram showing a manufacturing step following the steps in FIGS. 4A and 4B.

First, a metal pipe material 14 that is a quenchable steel type is prepared. As shown in FIG. 4A, the metal pipe material 14 is placed (injected) on the first and second electrodes 17 and 18 provided in the lower die 11 using, for example, a robot arm or the like. Since the first and second electrodes 17 and 18 have the recessed grooves 17*a* and 18*a*, respectively, the metal pipe material 14 is positioned by the recessed grooves 17*a* and 18*a*. Next, the controller 70 (see FIG. 1) controls the pipe holding mechanism 30 to hold the metal pipe material 14 by the pipe holding mechanism 30. Specifically, as in FIG. 4B, an actuator that allows the first and second electrodes 17 and 18 to advance or retreat is operated such that the first and second electrodes 17 and 18 positioned on the upper and lower sides, respectively, are brought closer to and into contact with each other. Due to this contact, both of the end parts of the metal pipe material 14 are sandwiched between the first and second electrodes 17 and 18 from the upper and lower sides. In addition, due to the presence of the recessed grooves 17*a* and 18*a* formed in the first and second electrodes 17 and 18, the metal pipe material 14 is sandwiched so as to firmly adhere over the whole periphery thereof.

Next, as shown in FIG. 1, the controller 70 controls the heating mechanism 50 to heat the metal pipe material 14. Specifically, the controller 70 turns on the switch 53 of the heating mechanism 50. In that case, electric power is supplied from the power supply 51 to the metal pipe material 14, and the metal pipe material 14 produces heat (Joule heat) due to the resistance present in the metal pipe material 14. In this case, the measurement value of the thermocouple 21 is monitored always, and based on the results thereof, the energization is controlled and the cylinder unit 42 of the gas supply mechanism 40 is operated. Accordingly, both ends of the metal pipe material 14 is sealed by the sealing member 44.

Figure 6:
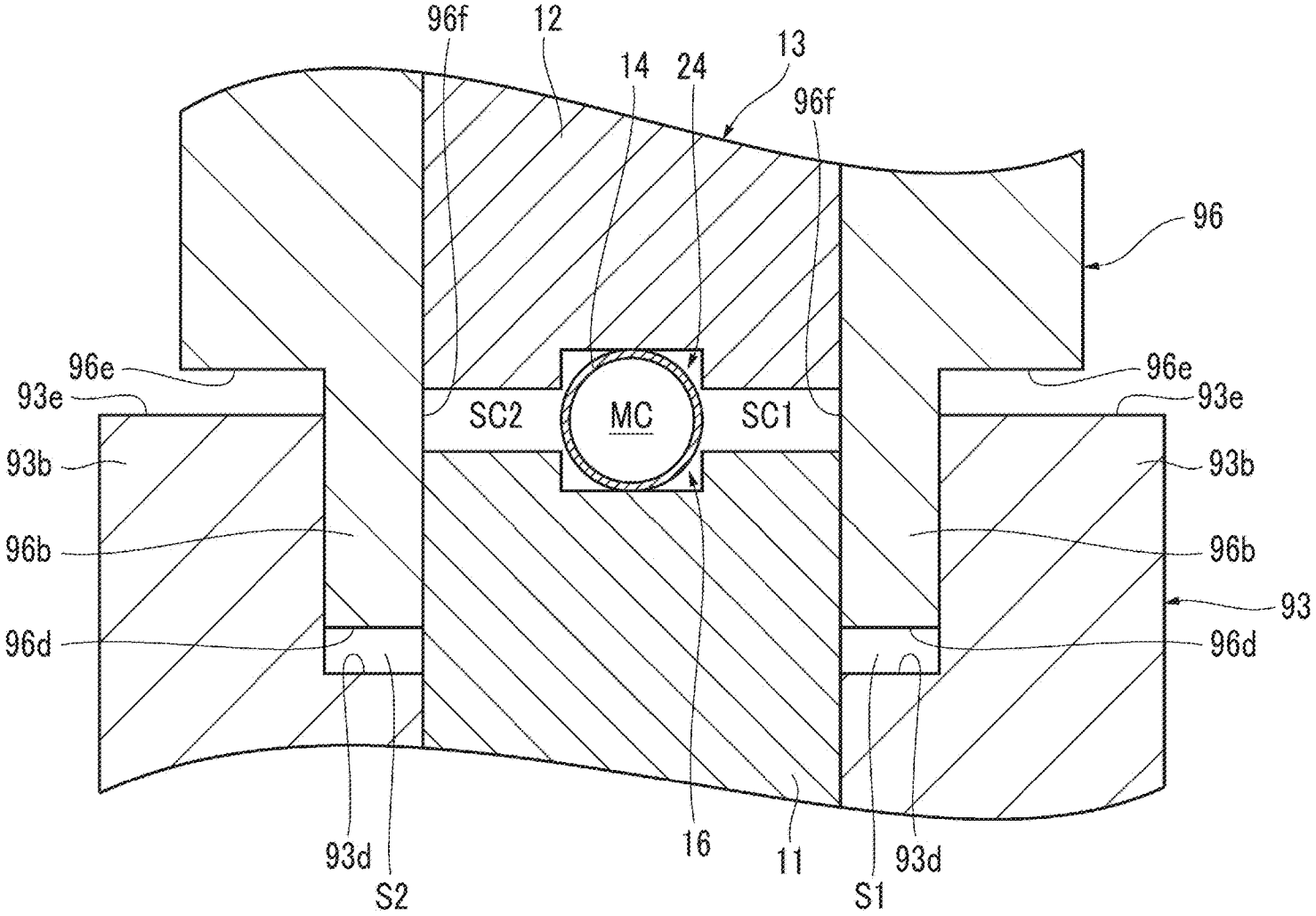
FIG. 6 is a diagram showing operations of the blow-forming die and an upper die holder and a change in shape of the metal pipe material.
Figure 7:
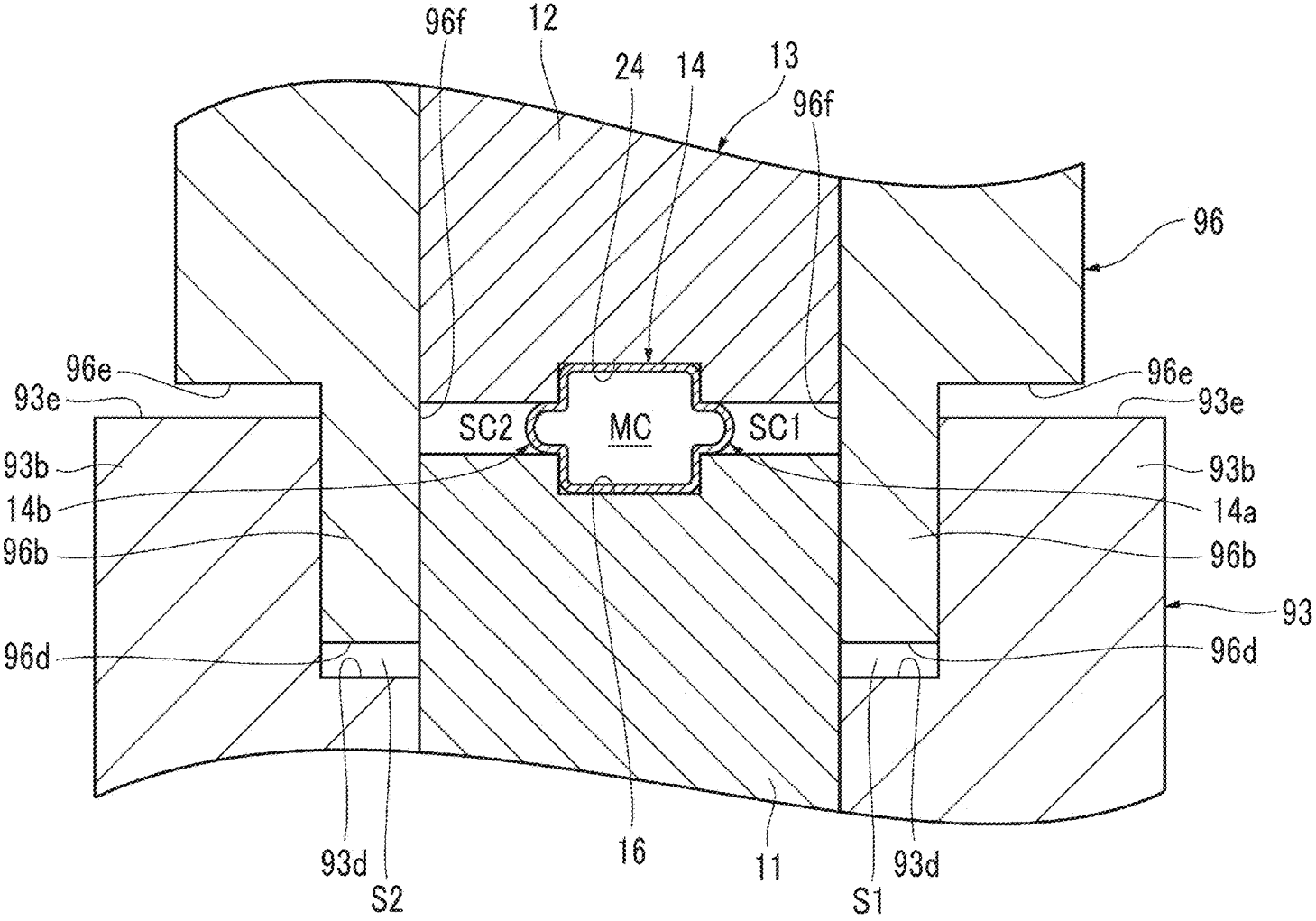
FIG. 7 is a diagram following FIG. 6.
Figure 8:
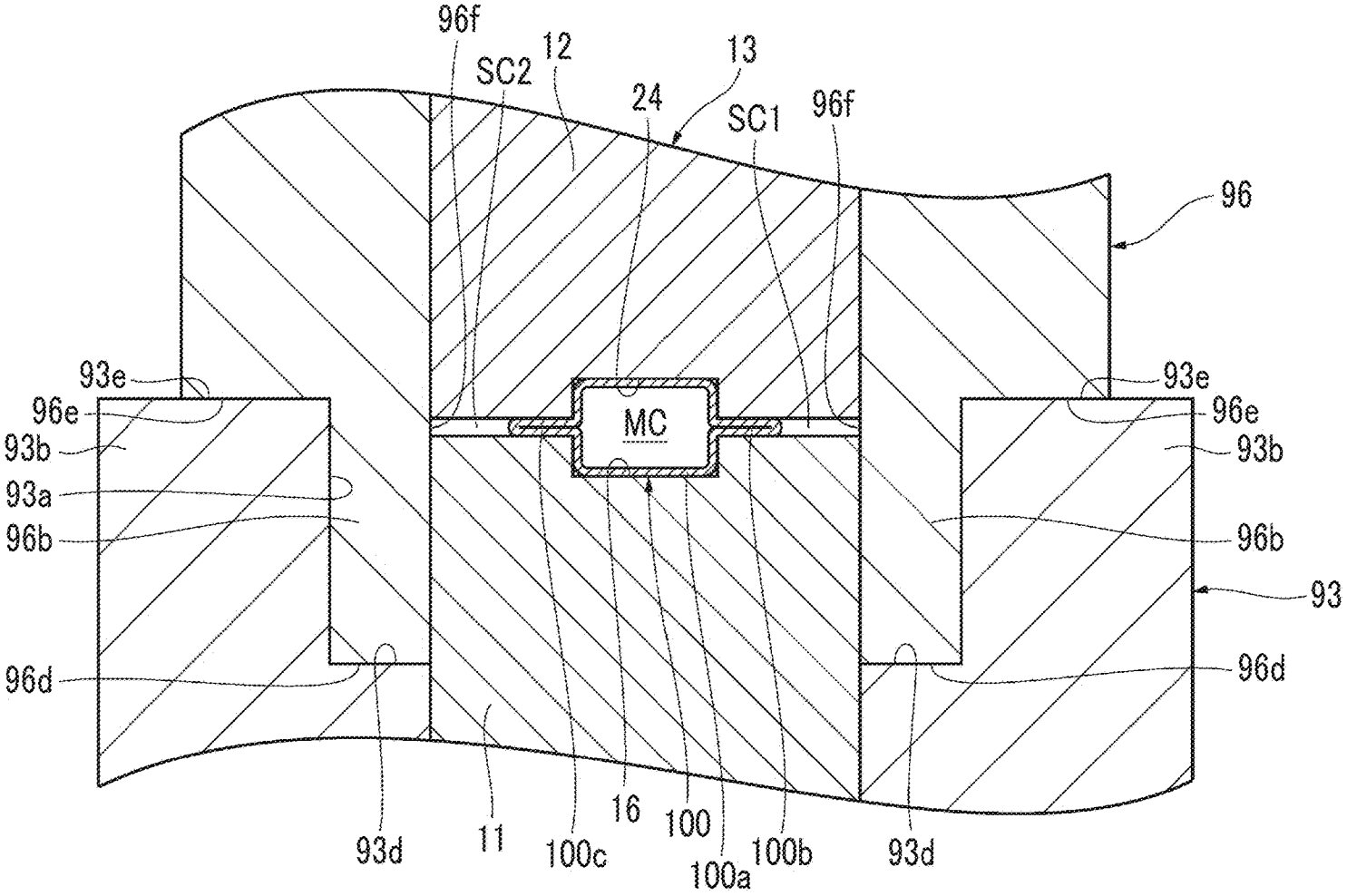
FIG. 8 is a diagram following FIG. 7.

FIG. 6 is a diagram showing operations of the blow-forming die and the upper die holder and a change in shape of the metal pipe material. FIG. 7 is a diagram following FIG. 6. FIG. 8 is a diagram following FIG. 7.

As shown in FIG. 6, the blow-forming die 13 is closed with respect to the metal pipe material 14 after heating. In this case, the protrusions 96*b* of the upper die holder 96 proceed into the spaces S1 and S2 of the lower die holder 93, and between the recessed part 16 of the lower die 11 and the recessed part 24 of the upper die 12, a main cavity part MC with a substantially rectangular cross-sectional shape is formed that is a gap for forming a pipe part (main body part) 100*a*. With this, sub-cavity parts SC1 and SC2 that communicate with the main cavity part MC and are gaps for forming flange parts 100*b* and 100*c* are respectively formed at both sides of the main cavity part MC between the upper end surface of the lower die 11 and the lower end surface of the upper die 12.

Here, the sub-cavity parts SC1 and SC2 between the upper end surface of the lower die 11 and the lower end surface of the upper die 12 extend to be opened to the outside of the die. The sub-cavity parts SC1 and SC2 are blocked from the outside by inner surfaces 96*f* of the protrusions 96*b* of the upper die holder 96. The protrusions 96*b* of the upper die holder 96, blocking the sub-cavity parts SC1 and SC2 from the outside of the die, are operated such that foreign matter such as fragments generated when, for example, the metal pipe bursts in the die is prevented from advancing out of the die through the sub-cavity parts SC1 and SC2 and from being discharged. Accordingly, the upper die holder 96 having the protrusions 96*b* also functions as a shielding member.

In this state, that is, in a state before the blow-forming die is completely closed, the metal pipe material 14 is fitted in the main cavity part MC. In a state in which the metal pipe material is in contact with the bottom surface of the recessed part 16 of the lower die 11 and the bottom surface of the recessed part 24 of the upper die 12, a high-pressure gas is supplied into the metal pipe material 14 by the gas supply part 60 to start blow forming.

Here, since the metal pipe material 14 is softened by being heated at a high temperature (about 950° C.), the gas supplied into the metal pipe material 14 is thermally expanded. Therefore, for example, with the use of compressed air as a gas to be supplied, the metal pipe material 14 at 950° C. can be easily expanded by thermally expanded compressed air.

In parallel with this, the blow-forming die 13 is further closed, and as shown in FIG. 7, the main cavity part MC and the sub-cavity parts SC1 and SC2 are further narrowed between the lower die 11 and the upper die 12.

Accordingly, the metal pipe material 14 is expanded in the main cavity part so as to follow the recessed parts 16 and 24, and parts (both side parts) 14*a* and 14*b* of the metal pipe material 14 are expanded so as to enter into the sub-cavity parts SC1 and SC2, respectively.

As shown in FIG. 8, the blow-forming die 13 is further closed, and thus the lower end surface 96*d* of the protrusion 96*b* of the upper die holder 96 is brought into contact with the bottom surface 93*d* of the recessed part 93*a* of the lower die holder 93, the step surface 96*e* of the upper die holder 96 is brought into contact with the upper end surface 93*e* of the protrusion 93*b* of the lower die holder 93, and the inner surface of the protrusion 93*b* of the lower die holder 93 and the outer surface of the protrusion 96*b* of the upper die holder 96 are brought into contact with each other. In a state in which the lower die holder 93 and the upper die holder 96 are firmly adhered to each other, the closing of the blow-forming die 13 is completed.

In this case, the main cavity part MC and the sub-cavity parts SC1 and SC2 are further narrowed than in the state shown in FIG. 7, and in this state, the sub-cavity parts SC1 and SC2 are blocked from the outside by the inner surfaces 96*f* of the protrusions 96*b* of the upper die holder 96 as described above.

Accordingly, the metal pipe material 14 softened by heating and supplied with the high-pressure gas is formed as the pipe part 100*a* with a rectangular cross-sectional shape following the rectangular cross-sectional shape of the main cavity part MC in the main cavity part MC, and formed as the flange parts 100*b* and 100*c* with a rectangular cross-sectional shape in which a part of the metal pipe material 14 is folded in the sub-cavity parts SC1 and SC2.

In this blow forming, quenching is performed in such a way that the outer peripheral surface of the metal pipe material 14 expanded by being subjected to the blow forming is brought into contact with the recessed part 16 of the lower die 11 so as to be rapidly cooled, and simultaneously, brought into contact with the recessed part 24 of the upper die 12 so as to be rapidly cooled (since the upper die 12 and the lower die 11 have a large heat capacity and are managed at a low temperature, the heat of the pipe surface is taken to the dies at once in a case where the metal pipe material 14 is brought into contact with the dies). Such a cooling method is referred to as die contact cooling or die cooling. shielding plate 202 that is erected on the upper transformation of austenite to martensite will be referred to as martensite transformation). Since the cooling rate is reduced in the second half of the cooling, the martensite is transformed to another structure (troostite, sorbate, or the like) owing to recuperation. Therefore, there is no need to perform a separate tempering treatment. In this embodiment, in place of or in addition to the die cooling, a cooling medium may be supplied to the metal pipe 100 to perform cooling. For example, the metal pipe material 14 may be brought into contact with the die (upper die 12 and lower die 11) to be cooled until the temperature is lowered to a temperature at which the martensite transformation starts, and then, the die may be opened and a cooling medium (gas for cooling) may be allowed to flow to the metal pipe material 14 to cause the martensite transformation.

By the above-described forming method, the metal pipe 100 having the pipe part 100*a* and the flange parts 100*b* and 100*c* can be obtained as a formed product as shown in FIG. 5. In this embodiment, since the main cavity part MC is configured to have a rectangular cross-sectional shape, the metal pipe material 14 is subjected to the blow forming in accordance with the shape, and thus the pipe part 100*a* is formed into a rectangular cylindrical shape. The shape of the main cavity part MC is not particularly limited. In accordance with a desired shape, any shape may be employed such as a circular cross-sectional shape, an elliptical cross-sectional shape, or a polygonal cross-sectional shape.

According to this embodiment, in the expanding and forming of the metal pipe material 14 in the main cavity part MC and the sub-cavity parts SC1 and SC2 communicating with the main cavity part MC in the blow-forming die 13, in a case where the material itself has a low strength, and thus the metal pipe bursts due to the high-pressure gas and foreign matter such as fragments is generated in the blow-forming die 13 (main cavity part MC or sub-cavity parts SC1 and SC2), foreign matter moving outward in the extending direction (horizontal direction in FIG. 8) of the sub-cavity parts SC1 and SC2 crossing the extending direction of the metal pipe material 14 is prevented from advancing by the protrusions 96*b* of the upper die holder 96 that is a shielding member provided on the extending line of the sub-cavity parts SC1 and SC2 in the expanding of the metal pipe material 14 and brought into contact with the side surfaces of the upper die 12. Accordingly, the foreign matter discharged from the main cavity part MC or the sub-cavity parts SC1 and SC2 can be securely prevented from scattering to the surroundings of the die without being discharged to the outside of the die.

In addition, the protrusion 96*b* of the upper die holder 96 is provided to be brought into contact with the side surface of the upper die 12, and blocks the sub-cavity parts SC1 and SC2 formed between the lower die 11 and the upper die 12 from the extending direction of the sub-cavity parts SC1 and SC2 when being moved with the movement of the upper die 12 to close the blow-forming die 13. Accordingly, the upper die holder 96 functions as a shielding member and there is no need to provide a separate shielding member. In addition, in a state in which the upper die holder 96 serves as a shielding member and is released from the die, the upper die holder 96 is separated upward from the lower die 11 together with the upper die 12. Accordingly, there is an advantage in that for example, in a case where the metal pipe material 14 is inserted into the lower die 11 or in a case where the formed metal pipe 100 is detached from the lower die 11, the protrusion 96*b* of the upper die holder 96 does not become a hindrance. The upper die holder 96 having the protrusion 96*b* is used as a shielding member since it is used particularly effectively as described above. However, the upper die holder 96 may have no protrusion 96*b* and the lower die holder 93 may be provided with a protrusion that is brought into contact with the side surface of the lower die 11 and protrudes upward to function as a shielding member that blocks the sub-cavity parts SC1 and SC2 formed between the lower die 11 and the upper die 12 from the extending direction of the sub-cavity parts SC1 and SC2 in a case where the die is closed.

Figure 9:
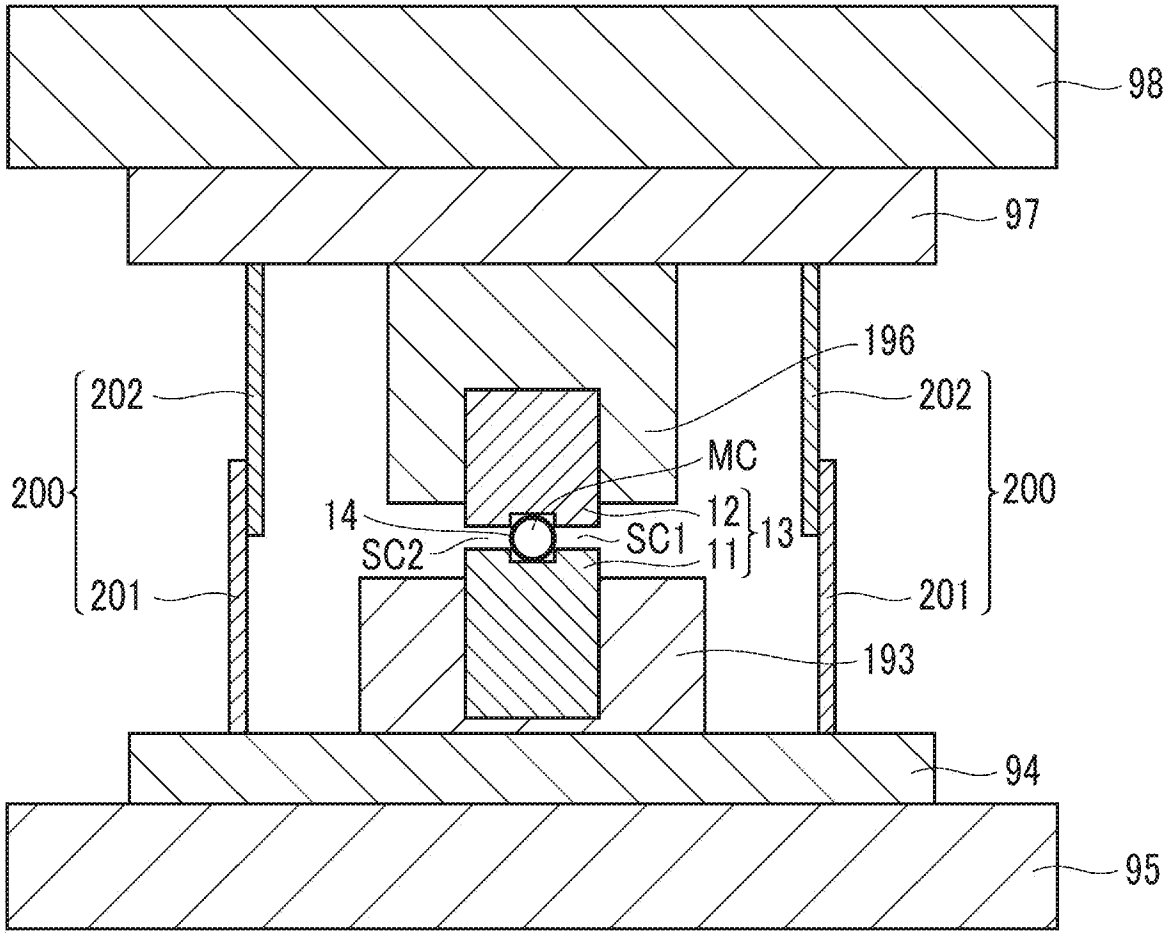
FIG. 9 is a schematic diagram showing a configuration of a main part of a forming device according to another embodiment of the invention.

FIG. 9 is a schematic diagram showing a configuration of a main part of a forming device according to another embodiment of the invention. Another embodiment is different from the previous embodiment in that by using an upper die holder 196 having no protrusion 96*b* in place of the upper die holder 96 and using a lower die holder 193 having no protrusion 93*b* in place of the lower die holder 93, the sub-cavity parts SC1 and SC2 are not blocked by the die holders 193 and 196 from the extending direction of the sub-cavity parts SC1 and SC2 in a case where the blow-forming die 13 is closed, and shielding plates 200, each constituting a shielding member, are provided at positions separated from the side surfaces of the die on the extending line of the sub-cavity parts SC1 and SC2, respectively.

The shielding plate 200 is provided with a lower shielding plate 201, the length in an axial direction (length in a direction perpendicular to the plane of FIG. 9) of which is almost the same as the length of the blow-forming die 13 in the axial direction, that is erected on the lower die member 94 and extends upward, and an upper shielding plate 202 that is erected on the upper die member 97 and extends downward.

In a state before the blow forming is started, the upper die 12 is largely separated upward from the lower die 11 (see FIG. 2). In this case, an upper part of the lower shielding plate 201 and a lower part of the upper shielding plate 202 does not overlap each other in a horizontal direction shown in the drawing, crossing the metal pipe material 14. In a state shown in the drawing in which the upper die 12 is moved downward to start the blow forming, the upper part of the lower shielding plate 201 and the lower part of the upper shielding plate 202 overlap each other in the horizontal direction shown in the drawing, crossing the metal pipe material 14, and the side surfaces thereof are brought into contact with each other. In this state in which the side surfaces are brought into contact with each other, in a case where the upper die 12 is further moved downward, the lower part of the upper shielding plate 202 is further moved downward while overlapping with the upper part of the lower shielding plate 201.

According to another embodiment, in the expanding and forming of the metal pipe material 14 in the main cavity part MC and the sub-cavity parts SC1 and SC2 communicating with the main cavity part MC in the blow-forming die 13, foreign matter such as fragments may be generated. In this case, the foreign matter moves outward in the extending direction of the sub-cavity parts SC1 and SC2 (horizontal direction in FIG. 9). In addition, the foreign matter is prevented from advancing by the shielding plates 200 provided on the extending line of the sub-cavity parts SC1 and SC2 in the expanding of the metal pipe material 14 and separated from the side surfaces of the die. Accordingly, the foreign matter discharged from the main cavity part MC or the sub-cavity parts SC1 and SC2 can be prevented from scattering to the surroundings of the die, specifically, to a region outside the shielding plates 200, and can be allowed to scatter only in a region inside the shielding plates 200 (region where no worker approaches during the operation).

Figure 10:
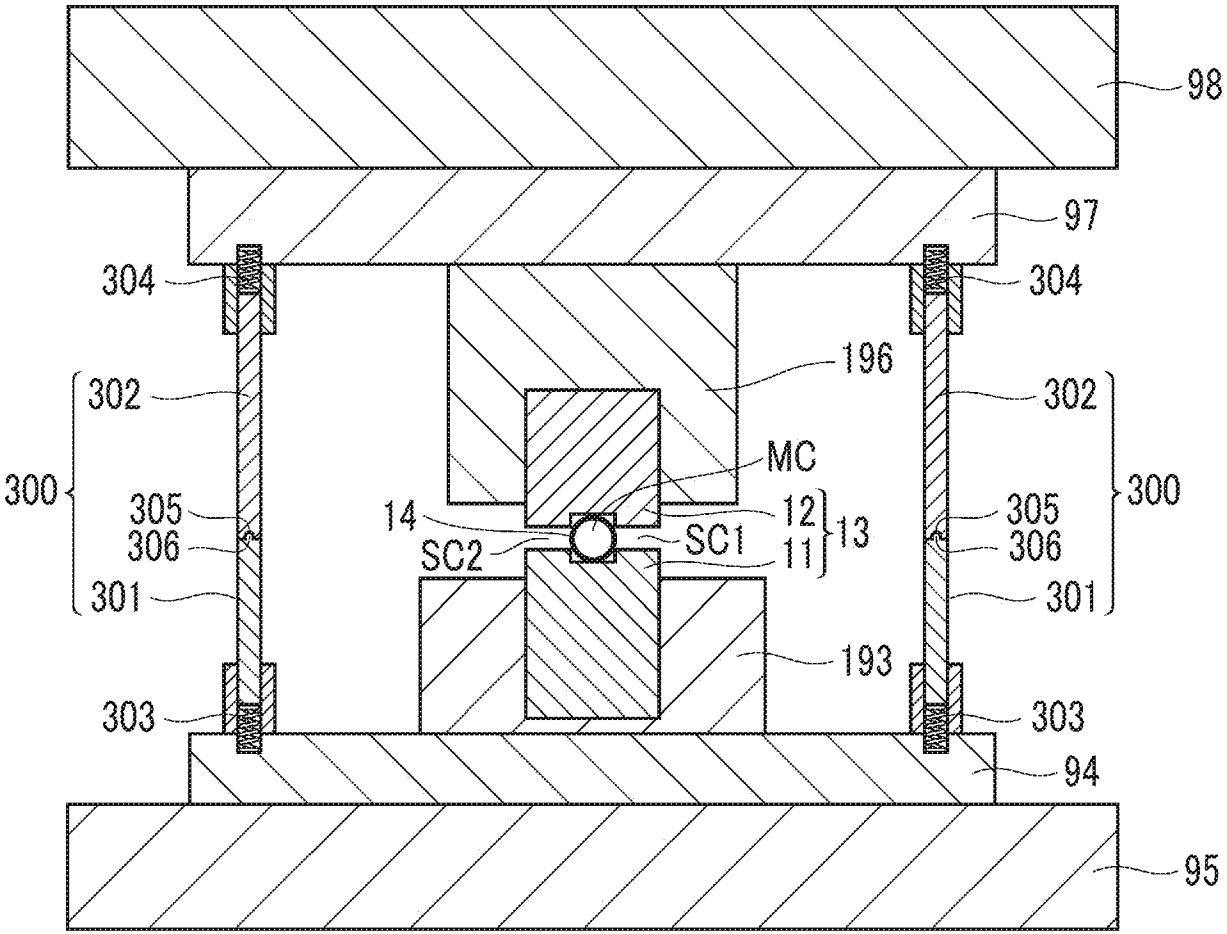
FIG. 10 is a schematic diagram showing a configuration of a main part of a forming device according to a still another embodiment of the invention.

FIG. 10 is a schematic diagram showing a configuration of a main part of a forming device according to a still another embodiment of the invention. The still another embodiment is different from the previous embodiment in that shielding plates (shielding members) 300 having a lower shielding plate 301 and an upper shielding plate 302, end parts of which are brought into contact with each other, are used in place of the shielding plates 200 having the lower shielding plate 201 and the upper shielding plate 202 overlapping each other.

The lower shielding plate 301 is biased upward by a compression coil spring 303 and supported movably up and down by the lower die member 94. The upper shielding plate 302 is biased downward by a compression coil spring 304 and supported movably up and down by the upper die member 97.

In a state before the blow forming is started, the upper die 12 is largely separated upward from the lower die 11 (see FIG. 2) and an upper end part of the lower shielding plate 301 and a lower end part of the upper shielding plate 302 are separated from each other. However, in a state shown in the drawing in which the upper die 12 is moved downward to start the blow forming, a protrusion 305 of the upper end part of the lower shielding plate 301 proceeds into and firmly adheres to a recessed part 306 of the lower end part of the upper shielding plate 302. Accordingly, even in a case where the upper die 12 and the upper shielding plate 302 are moved downward from the state shown in the drawing to close the blow-forming die 13, the compression coil springs 303 and 304 are compressed in the axial direction, and the state in which the protrusion 305 of the upper end part of the lower shielding plate 301 proceeds into and firmly adheres to the recessed part 306 of the lower end part of the upper shielding plate 302 is maintained.

According to the still another embodiment, in the expanding and forming of the metal pipe material 14 in the main cavity part MC and the sub-cavity parts SC1 and SC2 communicating with the main cavity part MC in the blow-forming die 13, foreign matter such as fragments may be generated. In this case, the foreign matter moves outward in the extending direction of the sub-cavity parts SC1 and SC2 (horizontal direction in FIG. 10). The foreign matter is prevented from advancing by the shielding plates 300 provided on the extending line of the sub-cavity parts SC1 and SC2 in the expanding of the metal pipe material 14 and separated from the side surfaces of the die. Accordingly, the foreign matter discharged from the main cavity part MC or the sub-cavity parts SC1 and SC2 can be prevented from scattering to the surroundings of the die, specifically, to a region outside the shielding plates 300, and can be allowed to scatter only in a region inside the shielding plates 300 (region where no worker approaches during the operation).

In place of the shielding plates 200 and 300 of the previous embodiments, a shielding member such as a shielding block may be disposed to block the sub-cavity parts SC1 and SC2 from the outside of the die (in a direction crossing the extending direction of the metal pipe material 14) in a case where the block forming die 13 is closed. The shielding member such as a shielding block is provided at a position separated from the dies 11 and 12 so as not to block the sub-cavity parts SC1 and SC2 before closing of the die, and is moved to a position to block the sub-cavity parts SC1 and SC2 in a case where the die is closed. In addition, a part or the whole part of the shielding member such as a shielding block may proceed into the sub-cavity parts SC1 and SC2 to block the sub-cavity parts.

Although preferable embodiments of the invention have been described, the invention is not limited to the above-described embodiments. For example, the forming device may not essentially have the heating mechanism 50, and the metal pipe material 14 may be heated in advance.

In the above-described embodiments, the upper die 12 is moved. However, in addition to or in place of the upper die 12, the lower die 11 may be moved. In a case where the lower die 11 is moved, the lower die 11 and the lower die holding part 91 are not fixed to the base 15, but attached to the driving mechanism.

It should be understood that the invention is not limited to the above-described embodiment, but may be modified into various forms on the basis of the spirit of the invention. Additionally, the modifications are included in the scope of the invention.

What is claimed is:

1. A forming device comprising:

a blow-forming die comprising a pair of dies;

a shielding member that is separated in distance in a first direction from the blow-forming; and a first die holder that is configured to hold one of the pair of dies, wherein the one of the pair of the dies is moveable towards the other of the pair of the dies in a second direction that is substantially perpendicular to the first direction in a manner that causes the blow-forming die to form:

a main cavity part between the pair of the dies, and a sub-cavity part between the shielding member and the main cavity part in a manner that the shielding member covers an edge of the sub-cavity part, wherein the blow-forming die, when one of the pair of the dies comes closest to the other of the pair of the dies, is configured to form a main part of a pipe in the main cavity and a flange of the pipe in the sub-cavity part in a manner that causes the pair of the dies and the flange surround a portion of the sub-cavity part, and a portion of the shielding member is connected to a part of the first die holder and movable with the first die holder.

2. The forming device according to claim 1, wherein the sub-cavity part is a space between the pair of the dies.

3. The forming device according to claim 1, wherein the blow-forming die commences forming the flange part of the pipe in the sub-cavity part after the one of the pair of the dies is brought into contact with the pipe.

4. The forming device according to claim 1, further comprising:

a second die holder that is configured to hold the other of the dies, wherein the portion of the shielding member is moveable in a manner that causes the shielding member to extend from the first die holder to the second die holder.

5. A forming device comprising:

a blow-forming die that comprises:

a first die, and a second die;

a shielding member that is separated in distance in a first direction from the blow-forming die; and a die holder that is configured to hold the second die, wherein the second die is moveable towards the first die in a second direction that is substantially perpendicular to the first direction in a manner that causes the blow-forming die to:

i) create a sub-cavity part between a main cavity part and the shielding member in a manner that the shielding member covers an edge of the sub-cavity part, and ii) form, when the second die comes closest to the first die, a main part of a pipe in the main cavity and a flange of the pipe in the sub-cavity part, wherein a portion of the shielding member is connected to a part of the die holder and movable with the die holder.

6. The forming device according to claim 1, further comprising:

a space between the blow-forming die and the shielding member.

7. The forming device according to claim 1, wherein the sub-cavity part is a space between the one of the pair of the dies and the other of the pair of the dies.

8. The forming device according to claim 1, wherein the one of the pair of the dies protrudes from the first die holder towards a second die holder and the other of the pair of the dies protrudes from the second die holder towards the first die holder.

9. The forming device according to claim 8, wherein the shielding member is configured to extend from the first die holder to the second die holder before the blow-forming die commences forming the flange of the pipe in the sub-cavity part.

10. The forming device according to claim 8, wherein the shielding member is configured to extend from the first die holder to the second die holder during formation of the flange part of the pipe in the sub-cavity part.

11. The forming device according to claim 8, wherein portions of the shielding member are moveable in a manner that extends the shielding member from the first die holder to the second die holder.

12. A forming device comprising:

a blow-forming die comprising a pair of dies;

a shielding member that is separated in distance in a first direction from the blow-forming die;

a first die holder that is configured to hold one of the pair of dies; and an additional shielding member, wherein the one of the pair of the dies is moveable towards the other of the pair of the dies in a second direction that is substantially perpendicular to the first direction in a manner that causes the blow-forming die to form:

a main cavity part between the pair of the dies, and a sub-cavity part between the shielding member and the main cavity part, wherein the blow-forming die, when one of the pair of the dies comes closest to the other of the pair of the dies, is configured to form a main part of a pipe in the main cavity and a flange of the pipe in the sub-cavity part in a manner that causes the pair of the dies and the flange surround a portion of the sub-cavity part, a portion of the shielding member is connected to a part of the first die holder and movable with the first die holder, the one of the pair of the dies protrudes from the first die holder towards a second die holder and the other of the pair of the dies protrudes from the second die holder towards the first die holder, and the additional shielding member extends from the first die holder.

13. The forming device according to claim 12, wherein the additional shielding member is configured to extend from the first die holder to the second die holder before the blow-forming die commences forming the flange part of the pipe in the sub-cavity part.

14. The forming device according to claim 12, wherein the sub-cavity part is between the shielding member and the additional shielding member.

15. The forming device according to claim 12, wherein the main cavity part is between the shielding member and the additional shielding member.

16. The forming device according to claim 12, wherein the one of the pair of the dies is between the shielding member and the additional shielding member.

17. The forming device according to claim 12, further comprising:

a space between the blow-forming die and the additional shielding member.

18. The forming device according to claim 1, wherein the shielding member is spaced apart from the main cavity part by a distance that is sufficient to prevent the pipe from coming into contact with the shielding member.

19. The forming device according to claim 1, wherein a first cooling water passage is within the one of the dies.

20. The forming device according to claim 19, wherein a second cooling water passage is within the other of the dies.

* * * * *